US007619155B2

(12) United States Patent
Teo et al.

(10) Patent No.: US 7,619,155 B2
(45) Date of Patent: Nov. 17, 2009

(54) METHOD AND APPARATUS FOR DETERMINING MUSICAL NOTES FROM SOUNDS

(75) Inventors: Kok Keong Teo, Singapore (SG); Kok Seng Chong, Singapore (SG); Sua Hong Neo, Singapore (SG)

(73) Assignee: Panasonic Corporation, Osaka (JP)

( * ) Notice: Subject to any disclaimer, the term of this patent is extended or adjusted under 35 U.S.C. 154(b) by 543 days.

(21) Appl. No.: 10/530,954

(22) PCT Filed: Sep. 25, 2003

(86) PCT No.: PCT/SG03/00232

§ 371 (c)(1),
(2), (4) Date: Apr. 8, 2005

(87) PCT Pub. No.: WO2004/034375

PCT Pub. Date: Apr. 22, 2004

(65) Prior Publication Data

US 2006/0021494 A1 Feb. 2, 2006

(30) Foreign Application Priority Data

Oct. 11, 2002 (SG) ..... 200206223-0

(51) Int. Cl.
*G10H 7/00* (2006.01)

(52) U.S. Cl. ..... 84/616; 84/609

(58) Field of Classification Search ..... 84/616, 84/609

See application file for complete search history.

(56) References Cited

U.S. PATENT DOCUMENTS 3,539,701 A * 11/1970 Milde ..... 84/641
5,038,658 A * 8/1991 Tsuruta et al. ..... 84/461
5,698,807 A * 12/1997 Massie et al. ..... 84/661
5,739,451 A * 4/1998 Winksy et al. ..... 84/609
5,777,252 A * 7/1998 Tada ..... 84/609
5,874,686 A * 2/1999 Ghias et al. ..... 84/609
5,922,982 A * 7/1999 Ishibashi ..... 84/615
5,936,180 A * 8/1999 Ando ..... 84/604
5,963,957 A * 10/1999 Hoffberg ..... 707/104.1
5,986,199 A * 11/1999 Peevers ..... 84/603
6,031,171 A * 2/2000 Tohgi et al. ..... 84/470 R
6,121,530 A * 9/2000 Sonoda ..... 84/609
6,188,010 B1 * 2/2001 Iwamura ..... 84/609

(Continued)

FOREIGN PATENT DOCUMENTS

WO 01/11496 2/2001

OTHER PUBLICATIONS

Smith, et al. "Music Information Retrieval Using Audio Input" *Proc. AAAI Spring Symposium on Intelligent Integration and Use of Text, Image, Video, and Audio Corpora* (1997) p. 1-5 http://www.cs.waikato.ac.nz/~ihw/papers/97LAS-RJM-IHW-Music-Info.pdf.

Li, et al. "Mandarin Four-tone Recognition with the Fuzzy C-means Algorithm" *IEEE International Fuzzy Systems Conference Proceedings* (1999) pp. 1059-1062.

*Primary Examiner*—Jeffrey Donels
*Assistant Examiner*—Christina Russell
(74) *Attorney, Agent, or Firm*—Ladas & Parry LLP

(57) ABSTRACT

This method and apparatus extract symbolic high-level musical structure resembling that of a music score. Humming or the like is converted with this invention into a sequence of notes that represent the melody that the user (usually human, but potentially animal) is trying to express. These retrieved notes each contain information such as a pitch, the start time and duration and the series contains the relative order of each note. A possible application of the invention is a music retrieval system whereby humming forms the query to some search engine.

23 Claims, 13 Drawing Sheets

U.S. PATENT DOCUMENTS 6,392,132 B2 * 5/2002 Uehara ..... 84/477 R
6,437,227 B1 * 8/2002 Theimer ..... 84/609
6,476,306 B2 * 11/2002 Huopaniemi et al. ..... 84/609
6,476,308 B1 * 11/2002 Zhang ..... 84/616
6,528,715 B1 * 3/2003 Gargi ..... 84/615
6,816,833 B1 * 11/2004 Iwamoto et al. ..... 704/207
7,003,515 B1 * 2/2006 Glaser et al. ..... 707/5
2002/0088336 A1 * 7/2002 Stahl ..... 84/609
2003/0023421 A1 * 1/2003 Finn et al. ..... 704/1
2004/0186708 A1 * 9/2004 Stewart ..... 704/207
2004/0221710 A1 * 11/2004 Kitayama ..... 84/654
2005/0086052 A1 * 4/2005 Shih ..... 704/207
2006/0065102 A1 * 3/2006 Xu ..... 84/600
2006/0289622 A1 * 12/2006 Khor et al. ..... 235/375
2007/0119288 A1 * 5/2007 Makino ..... 84/602
2007/0131094 A1 * 6/2007 Kemp ..... 84/609
2007/0162497 A1 * 7/2007 Pauws ..... 707/104.1
2007/0163425 A1 * 7/2007 Tsui et al. ..... 84/609

* cited by examiner

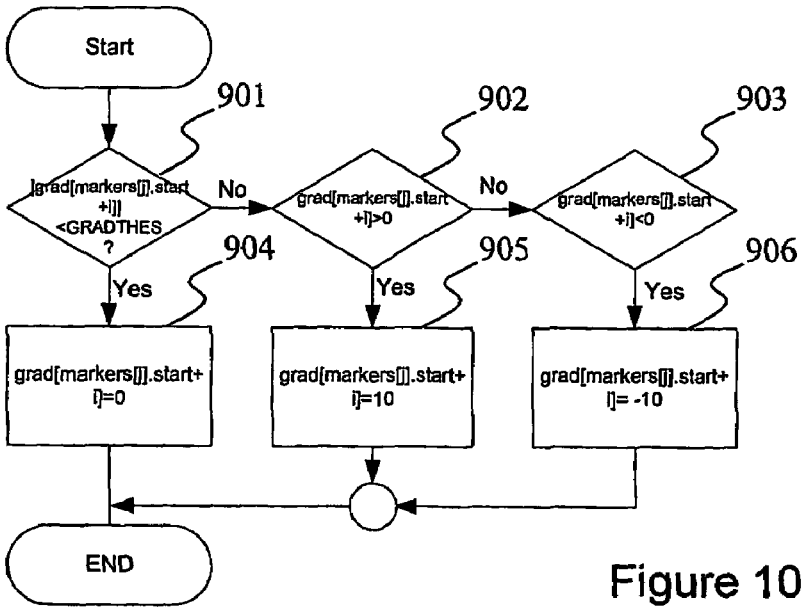
Figure 10
Figure 11
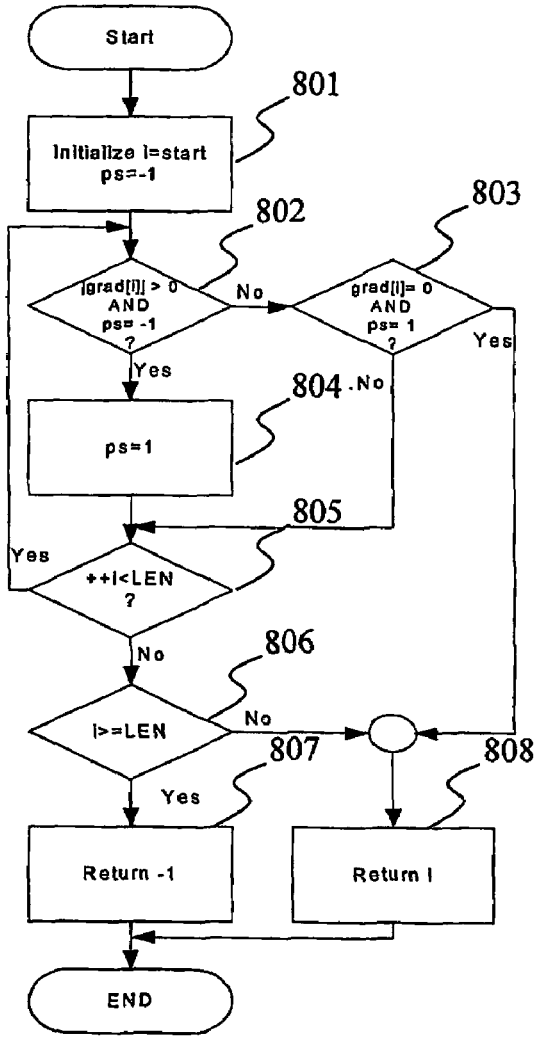

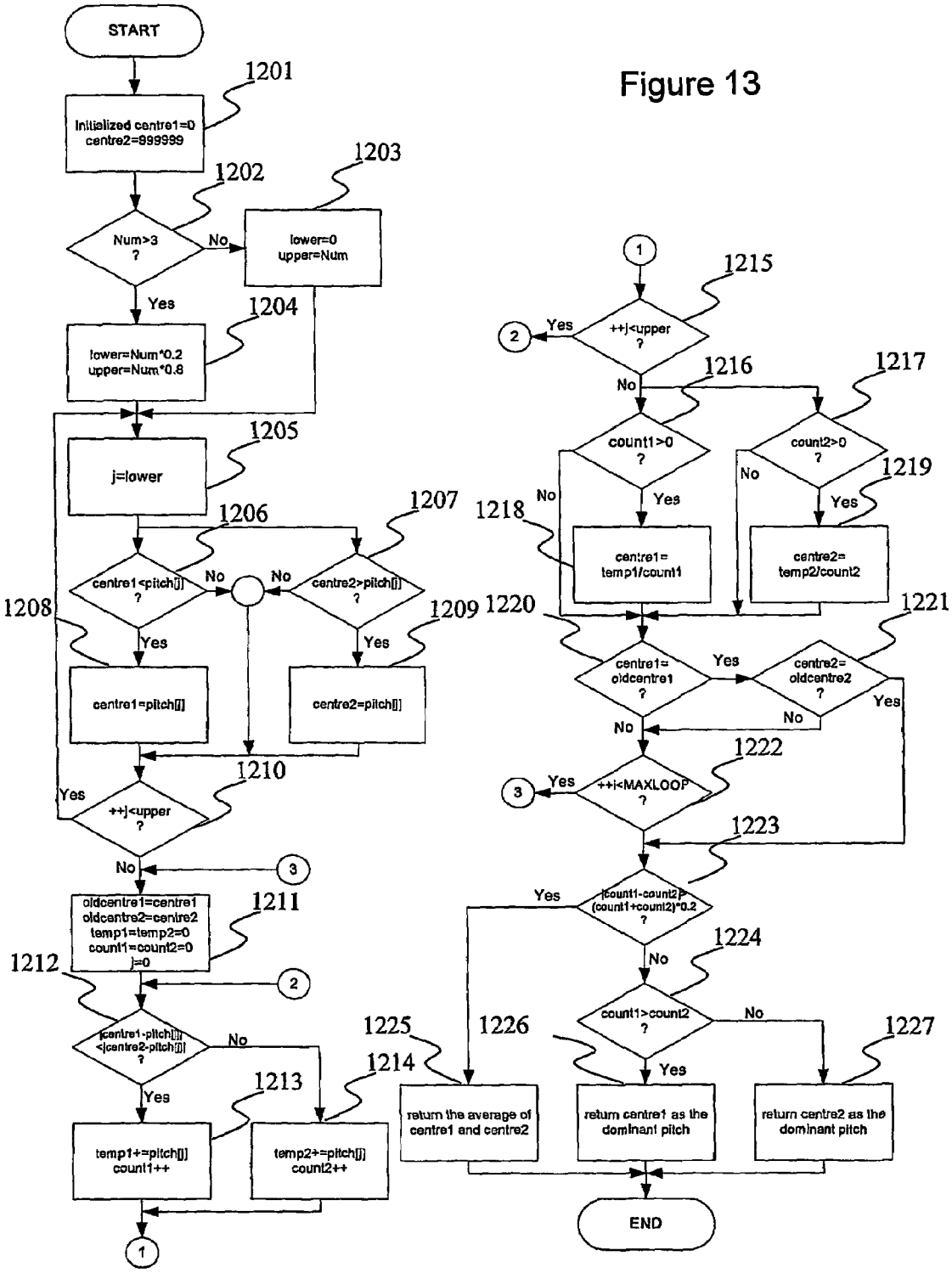
START
1201
Initialized centre1=0
centre2=999999
1202
Num>3
?
No
1203
lower=0
upper=Num
Yes
1204
lower=Num*0.2
upper=Num*0.8
1205
j=lower
1206
1207
centre1<pitch[j]
?
No
No
centre2>pitch[j]
?
1208
1209
Yes
Yes
centre1=pitch[j]
centre2=pitch[j]
1210
Yes
++j<upper
?
No
3
1211
oldcentre1=centre1
oldcentre2=centre2
temp1=temp2=0
count1=count2=0
j=0
1212
2
|centre1-pitch[j]|
<|centre2-pitch[j]|
?
No
Yes
1213
1214
temp1+=pitch[j]
count1++
temp2+=pitch[j]
count2++
1
Figure 13
1
1215
2
Yes
++j<upper
?
No
1216
1217
count1>0
?
count2>0
?
No
Yes
Yes
1218
1219
centre1=
temp1/count1
centre2=
temp2/count2
1220
1221
centre1=
oldcentre1
?
Yes
centre2=
oldcentre2
?
Yes
No
No
1222
3
Yes
++i<MAXLOOP
?
1223
Yes
|count1-count2|>
(count1+count2)*0.2
?
No
1224
count1>count2
?
No
Yes
1225
1226
1227
return the average of
centre1 and centre2
return centre1 as the
dominant pitch
return centre2 as the
dominant pitch
END

METHOD AND APPARATUS FOR DETERMINING MUSICAL NOTES FROM SOUNDS

FIELD OF THE INVENTION

The present invention relates to determining musical notes from sounds, such as humming or singing. In particular it relates to converting such sounds into notes and recognising them for the purpose of music retrieval. It also relates to the component means and processes.

BACKGROUND ART

Multimedia content is an increasingly popular resource, supported by a surging market for personal digital music devices, an increase of bandwidth to the home and the emergence of 3G wireless devices. There is an increasing need for an effective searching mechanism for multimedia content. Though many systems exist for content-based retrieval of images, few mechanisms are available to retrieve the audio portion of multimedia content. One possibility for such mechanisms is retrieval by humming, whereby a user searches by humming melodies of a desired musical piece into a system. This incorporates a melody transcription technique.

FIG. 1 shows a flowchart for a known system of humming recognition. The melody transcription technique consists of a silence discriminator 101, pitch detector 102 and note extractor 103. It is assumed that each note will be separated by a reasonable amount of silence. This reduces the problem of segmentation to a silence detection problem.

In U.S. Pat. No. 6,188,010 a FFT (Fast Fourier Transform) algorithm is used to analyse sound by obtaining the frequency spectrum information from waveform data. The frequency of the voice is obtained and finally a music note that has the nearest pitch is selected.

In U.S. Pat. No. 5,874,686 an autocorrelation-based method is used to detect the pitch of each note. In order to improve the performance and robustness of the pitch-tracking algorithm, a cubic-spline wavelet transform or other suitable wavelet transform is used.

In U.S. Pat. No. 6,121,530 the onset time of the voiced sound is divided off as an onset time of each note, a time difference with an onset time of the next note is determined as the span of the note and the maximum value among the fundamental frequencies of each note contained during its span is defined as the highest pitch values.

Automatic melody transcription is the extraction of an acceptable musical description from humming. Typical humming signal consists of a sequence of audible waveforms interspersed with silence. However, there is difficulty in defining the boundary of each note in an acoustic wave and there is also considerable controversy over exactly what pitch is. Sound recognition involves using approximations. Where boundaries between notes are clear and pitch is constant, the prior art can produce reasonable results. However, that is not necessarily so where each audible waveform may contain several notes and pitch is not necessarily maintained, as happens with real people humming. A hummer's inability to maintain a pitch often results in pitch changes within a single note, which may be subsequently misinterpreted as a note change. On the other hand, if a hummer does not pause adequately when humming a string of the same notes, the transcription system might interpret it as one note. The task becomes increasingly difficult in the presence of expressive variations and the physical limitation of the human vocal system.

OBJECT AND SUMMARY OF THE INVENTION

It is therefore an aim of the present invention to provide an improved system for recognising hummed tunes or the like and to provide component processes and apparatus that can be used in such a venture.

According to a first aspect of the invention, there is provided a method for use in transcribing a musical sound signal to musical notes, comprising the steps of:

- producing note markers, indicative of the beginnings and ends of notes in said sound signal; and
- detecting the pitch values of notes marked by said note markers.

Preferably this method further comprises detecting portions of said sound signal that can be deemed to be silences.

This method may also further comprise the step of extracting notes from said pitch values to create note descriptors.

According to a second aspect of the invention, there is provided a method for detecting portions of a musical sound signal that can be deemed to be silences, comprising the steps of:

- dividing said sound signal into at least one group of blocks;
- deriving short-time energy values of said blocks in a group;
- deriving a threshold value based on said short-time energy values; and
- using said threshold value to classify blocks of said group as silent or otherwise.

According to a third aspect of the invention, there is provided a method of producing note markers, indicative of the beginnings and endings of notes in a musical sound signal, comprising the steps of:

- extracting an envelope of said sound signal;
- differentiating said envelope to compute a gradient function; and
- extracting note markers from said gradient function, indicative of the beginnings and ends of notes in said sound signal.

The process of envelope extraction may comprise the steps of:

- performing full-wave rectification on said sound signal; and
- low-pass filtering the output of the full-wave rectification.

The process of differentiation may comprise the steps of:

- determining the gradient of said envelope; and
- low-pass filtering said gradient.

The process of note markers extraction may comprises the steps of:

- removing small gradients from said gradient function;
- extracting turning points of the attack and decay of remaining gradients;
- removing unwanted attacks and decays; and
- registering remaining attacks and decays as said note markers.

According to a fourth aspect of the invention, there is provided a method for detecting the pitch values of notes in a musical sound signal, comprising the steps of:

- isolating notes in the sound signal;
- dividing said notes into one or more groups of blocks;
- deriving pitch values of said blocks; and
- deriving the pitch values of said notes by means of clustering on said pitch values of said blocks.

This process of isolating notes may use note markers to do so.

One or more of the above aspects may be combined.

According to a fifth aspect of the invention, there is provided a method of identifying pieces of music, comprising the steps of:

receiving a musical sound signal imitative of a piece of music;

transcribing said musical sound signal to a series of musical notes and timings using the method of the first aspect above;

comparing said series of musical notes and timings with series of notes and timings of pieces of music in a database; and identifying the piece of music deemed most similar by this comparison.

Following this, the identified piece of music may then be retrieved.

The invention is not limited to human use. It may be useful in conducting experiments with animals. Moreover, it is not limited to humming, but could be used with whistling, singing or other noise production.

The invention also provides apparatus operable according to the above methods and apparatus corresponding to the above methods.

This method and apparatus extract symbolic high-level musical structure resembling that of a music score. Humming or the like is converted with this invention into a sequence of notes that represent the melody that the user (usually human, but potentially animal) is trying to express. These retrieved notes each contain information such as a pitch, the start time and duration and the series contains the relative order of each note. A possible application of the invention is a music retrieval system whereby humming forms the query to some search engine. Music retrieval via query-by-humming can be applied to different applications such as PC, cellular phone, portable jukebox, music kiosk and car jukebox.

BRIEF DESCRIPTION OF DRAWING

The present invention is now further described by way of non-limitative example, with reference to the accompanying drawings, in which:—

FIG. 10 is a flowchart of a gradient threshold function used in the embodiment of FIG. 2;

FIG. 11 is a flowchart of operation of an edge detector used in the embodiment of FIG. 2;

FIG. 13 is a flowchart of operation of a dominant pitch detector used in the embodiment of FIG. 2.

SPECIFIC DESCRIPTION

A robust melody transcription system is proposed to serve as an ensemble of solutions to solve the problem of transcribing humming signal to note descriptors. A melody technique is used to produce note descriptors. This information is used by a feature extractor to obtain features to be used in a search engine.

Figure 2:
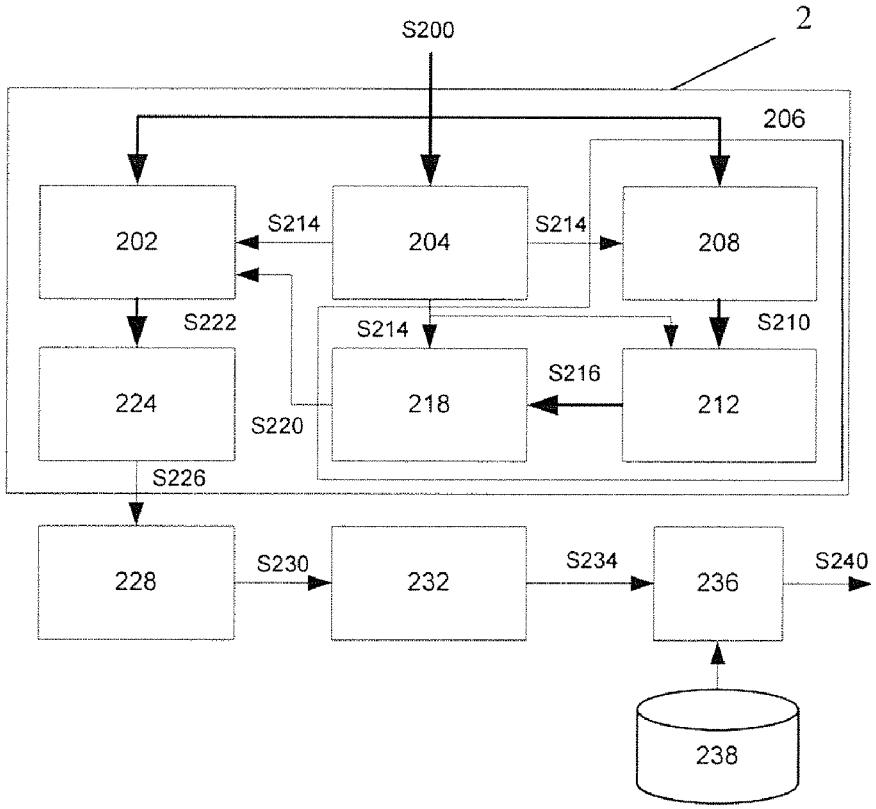
FIG. 2 is a schematic block diagram of an embodiment of the present invention.

FIG. 2 is a schematic block diagram of an embodiment of the present invention. A digitised humming input signal S200 from a PC, cell phone, portable jukebox, music kiosk or the like, is input into a melody transcription device 2. There it is input in parallel into a pitch detector 202, a silence discriminator 204 and a gradient based segmentation unit 206, where it first goes into an envelope detector 208. The envelope detector 208 produces an envelope signal S210 from the humming signal, which is input into a differentiating circuit 212. Another input into this is a silence marker signal S214 from the silence discriminator 204. The output from the differentiating circuit 212 is a gradient function signal S216, which is input into a note marker extractor 218, which also receives the silence marker signal S214 from the silence discriminator 204. The note marker extractor 218 outputs a note marker signal S220, which, together with the silence marker signal S214 and humming input signal S200, is input into the pitch detector 202. The gradient based segmentation unit 206 is made up of the envelope detector 208, the differentiating circuit 212 and the note marker extractor 218.

Using the three inputs, the pitch detector 202 produces a pitch value signal S222, from which a note extractor circuit 224 produces a note descriptor signal S226. This then is output from the melody transcription device 2. In this example, a feature extraction circuit 228 produces a feature signal S230, from the note descriptor signal S226. An MPEG-7 descriptor generator 232 uses this to produce a feature descriptor signal S234, which is fed to a search engine 236. Searching using a music database 238 gives a search result S240.

The silence discriminator 204 illustrated in FIG. 2 is employed to isolate the audible portion of the input humming signal S200 from the silence. The pitch detector 202 is used to compute the pitch of the humming input S200. The structure of the audible waveform is complex but the present invention uses detection of an attack and decay pair indicating the existence of a note. Thus the envelope detector 208 is employed to remove the complex structure of the audible waveform. The differentiator 212 computes the gradient of the envelope S210. Another difficulty is the ambiguous nature of the attack and decay pair that symbolises the existence of a note. Unlike musical instruments, people cannot transit to the next note with a boundary that is well defined. The problem is compounded by the fact that the volume may change due to expression or failure by the hummer to maintain the volume. The volume change might create a false attack and decay within the duration of a particular note. The note marker extractor 218 is therefore used to remove all the false attacks and decays. The legitimate attack and decay pairs left are used as note makers that mark the start and end of a note. With the knowledge of the location of each note, the pitch detector 202 computes the pitch of each note. Finally, the note extractor 224 is employed to map the pitch values and note markers to produce note descriptors. A note descriptor contains information such as pitch, start time and interval of a particular note.

In this preferred embodiment, the melody transcription system comprises two distinct steps: segmentation and pitch detection. The segmentation step searches the digital signal S200 to find the start and duration of all notes that the hummer tries to express. The silence discriminator 204 isolates the voiced portions. This information has been used in the prior art to segment the digital signal. This is only feasible if a hummer inserts a certain amount of silence between each note. Most inexperienced hummers have difficulties inserting silence between notes. In this invention, a gradient-based segmentation method is employed to search for notes within the voiced portions, thus not relying so much on silence discrimination.

The humming signal is similar to an amplitude modulated (AM) signal where the volume is modulated by the pitch frequency. The pitch signal is not useful in this case, which is removed to extract the envelope. The envelope shows some interesting properties of a typical humming signal. The envelope increases sharply from silence to a stable level. The stable level is maintained for a while before it drops back sharply to silence again. Thus the existence of an attack, followed by a steady level and a decay of a note, is evidence of the existence of a note. The gradient-based segmentation is derived from these unique properties to extract the note markers.

These note markers are used in this invention to enhance the performance of the pitch detector 202. The approach is to exploit the fact that the pitch within each pair of start and end note makers is supposed to be constant. The signal of each note is divided into blocks of equal length. The signal in each block is assumed to be stationary and the pitch (frequency) is detected by autocorrelation. In an ideal case, these values are identical. However, the autocorrelation pitch detector 202 is sensitive to harmonics that cause errors in the detection of pitch. Furthermore, hummers frequently fail to maintain the pitch within the duration of a particular note. A k-mean clustering algorithm is selected in this invention to find the prominent pitch value.

Music retrieval by humming is perceived as an excellent complement to tactile interfaces on handheld devices, such as mobile phones and portable jukeboxes. This invention can also be employed in a ring-tone retrieval system whereby a user can download the desired ring-tone by humming to a mobile device.

Thus, in this embodiment, a user hums a tune into a microphone attached to a PC, cell phone, portable jukebox, music kiosk or the like, where the input sound is converted into a digital signal and transmitted as part of a query. The query is sent to a search engine. Melody transcription and feature extraction modules in the search engine extract relevant features. At the same time, the search engine requests MPEG-7 compliant music metadata from music metadata servers on its list. The search proceeds to match the music metadata with the features extracted from the humming query. The result is sent back to the user, with an indication of the degree of match (in the form of a score) and the location of the song(s). The user can then activate a link provided by the search engine to download or stream the song from the relevant music collection server—possibly for a price. The MPEG-7 descriptor generator is optional and depends on the application scenario.

Such a mechanism entails a robust melody transcription subsystem, which extracts symbolic high-level musical structure resembling that on a music score. Thus the humming must be converted into a sequence of notes that represent the melody that the user tries to express. The notes contain information such as the pitch, the start time and the duration of the respective notes. Thus it requires two distinct steps: the segmentation of the acoustic wave and detection of the pitch of each segment.

Figure 1:
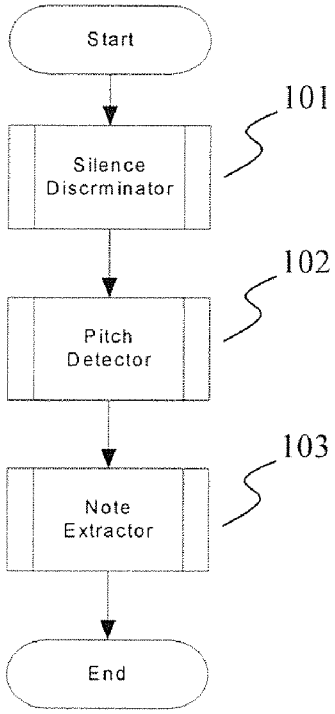
Figure 1 (Prior Art)
FIG. 1 is a flowchart of a prior art melody transcription technique.
Figure 3:
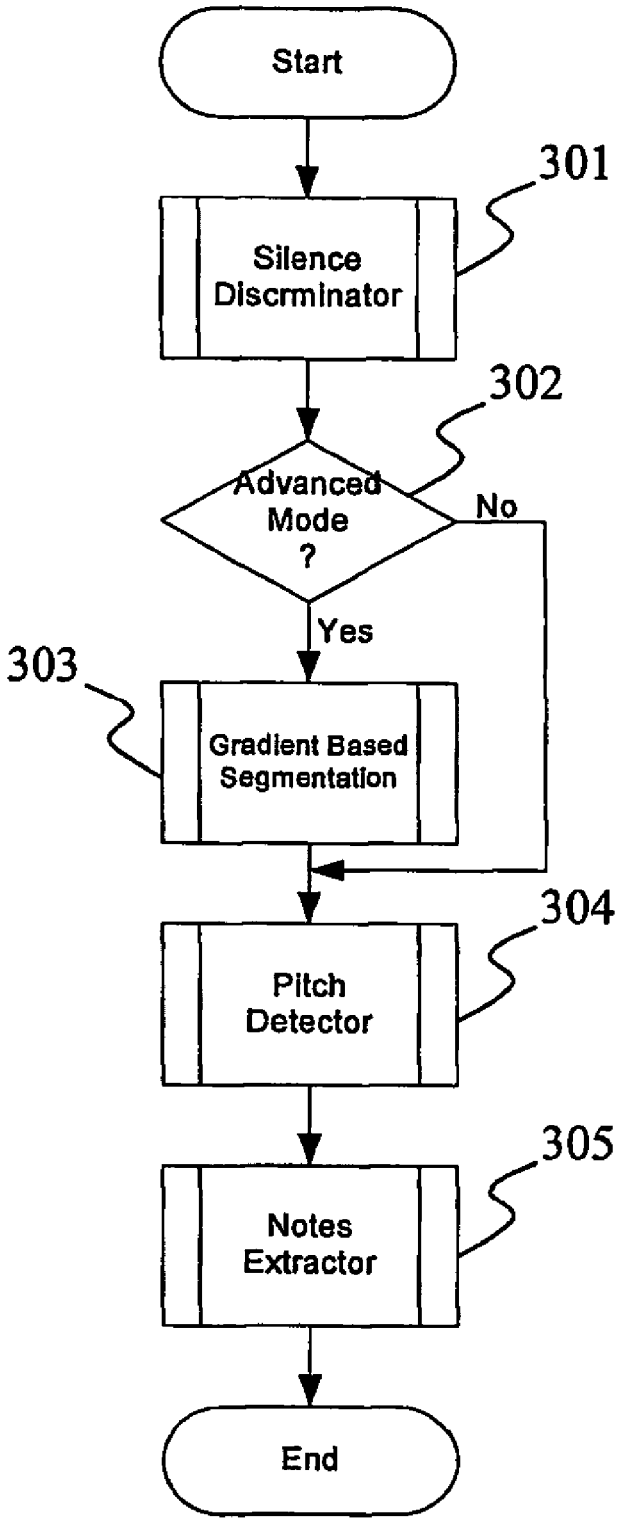
FIG. 3 is a flowchart of a melody transcription technique used in the embodiment of FIG. 2.

In the prior art shown in FIG. 1, the melody transcription technique consists of a silence discriminator, pitch detector and note extractor. FIG. 3 is a similar flowchart, showing the components of the present invention. Once again, there is a silence discriminator step 301 and a pitch detector step 304, which leads to a note extractor step 305. However, in this invention, an additional step is introduced into the conventional technique in the form of an 'advanced mode' option step 302, following on from silence discriminator step 301. The selection of the advanced mode activates the gradient-based segmentation step 303. This step is made up of the processes conducted in the gradient based segmentation unit 206 of FIG. 2. Thus the process 303 searches for note markers within each voiced waveform. Note markers found are processed in the pitch detector and note extractor steps, 304 and 305 respectively.

Silence Discriminator

Figure 4:
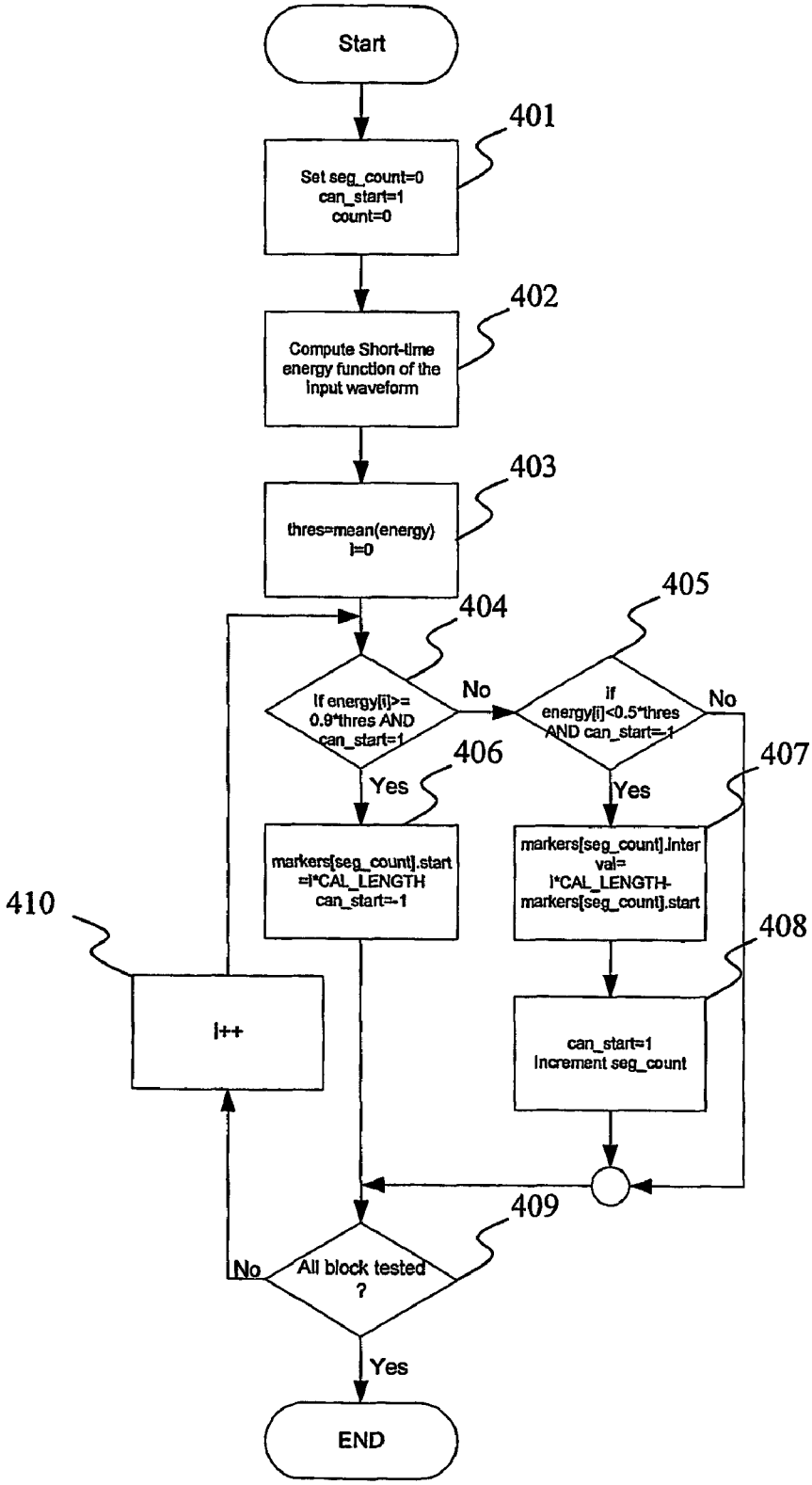
FIG. 4 is a flowchart of operation of a silence discriminator used in the embodiment of FIG. 2.

FIG. 4 is a flowchart of the operation of an exemplary silence discriminator 204 of FIG. 2, the silence discriminator isolating the voiced portion in the input waveform. The first step is to isolate the voiced portions from the silence portions of digitised hum waveform. By preventing the processing of silence portions, it improves performance and reduces computation. A data structure is set up using the syntax of the C programming language.

```
struct markers{
        int start;
        int interval;
        };
```

where markers is the struct that marks the start and the interval of the voiced portion. Thus there is an array of these markers with seg_count members.

The necessary parameters are initialised to: seg_count=0, can_start=1 and count=0, as shown in 401. The parameter can_start is initialised to '1' to signal that a new marker is allowed to be created. This is to prevent creating markers before an interval of voiced portion is registered. It is followed by process 402 to compute the short-time energy function of the digitised hum waveform. The digitised hum waveform is divided into blocks of equal length. The short-time energy, $E_n$, for each block is computed as:

$$E_n = \frac{1}{\text{CAL_LENGTH}} \sum_{m}^{\text{CAL_LENGTH}} [(x(m)w(n-m))]^2$$

where x(m) is the discrete time audio signal, w(m) is a rectangle window function and CAL_LENGTH is the length of window and the width of a block of hum waveform.

In order to be adaptive to different recording environments, the threshold, thres, is computed as the average of the short-time energy and a count number is set, i=0, as shown in 403. The thres is the average short-time energy. This is a reference value used to decide whether the signal at a particular time is silence or voiced. With the threshold, the short-time energy of each block is tested as shown in 404 and 405. In 404, the current short-time energy value, energy(i), is tested to determine whether its level is greater than or equal to 0.9 times the threshold and, at the same time, the can_start=1. If the criteria are met, the process proceeds to block 406, where the start of the current block is registered as the start of a voiced portion in 406. The position is calculated as:

markers[seg_count].start=*i**CAL_LENGTH where i is the index of the current short-time energy.

Furthermore, the can_set is set to '−1' to indicate that the algorithm is expecting a silence portion hence another voiced portion cannot be registered. If, in step 404, the criteria are not met, the process goes to step 405, where the current short-time energy value, energy(i), is tested to determine whether its level is below 0.5*thres and, at the same time, the can_start=−1. This is taken to mean that the beginning of a silence portion has been reached and, if these criteria are met, this is registered as an interval in the voiced portion in step 407. The position is calculated as:

markers[seg_count].interval=*i**CAL_LENGTH−
markers[seg_count].start.

Following this, the can_start is set to '1' again to flag that the registration of new marker is allowed and the seg_count is incremented as shown in 408. The outputs of steps 406 and 408, together with the output of step 405 if the criteria are not met, rejoin in step 409, which asks if all blocks have been tested. If the answer is negative, i, the index of the current short-time energy is incremented by 1 in step 410 and the process returns to step 404. The processes of steps 404-410 are repeated until all the values in the short-time energy function have been tested.

Gradient Based Segmentation

Figure 5A:
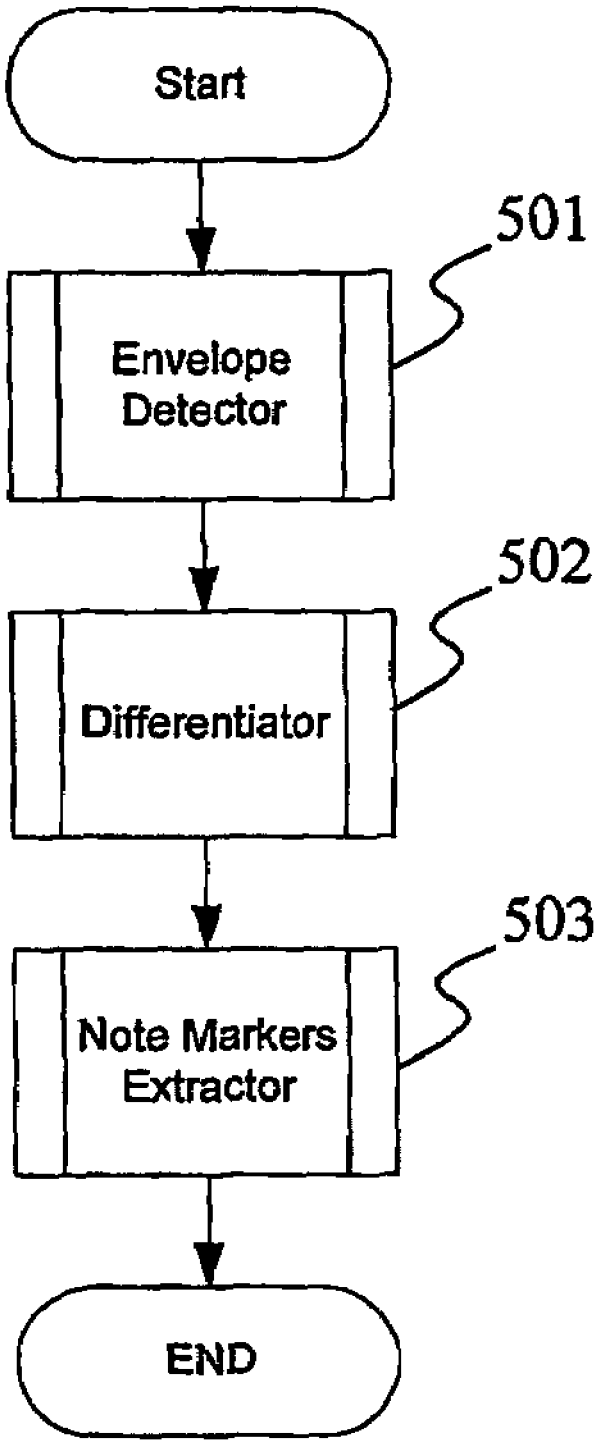
FIG. 5A is a flowchart of gradient-based segmentation used in the embodiment of FIG. 2.
Figure 5B:
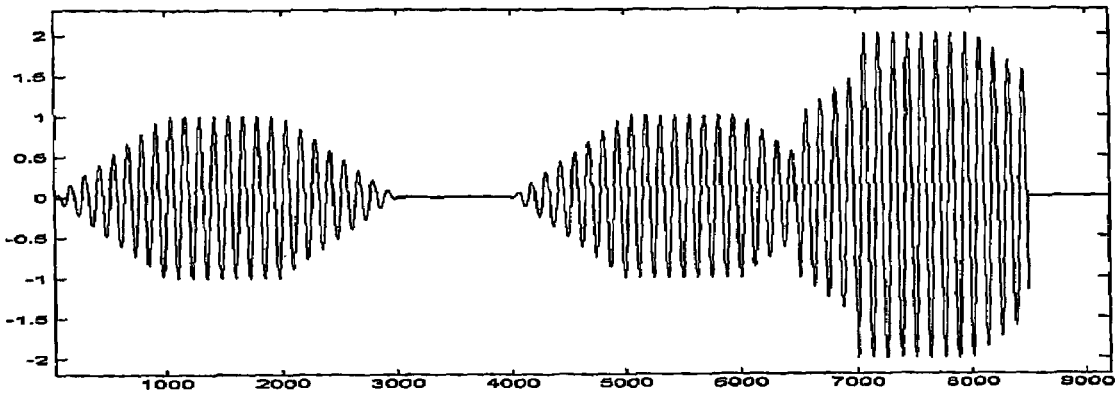
FIG. 5B is an illustration of a typical humming waveform.
Figure 5C:
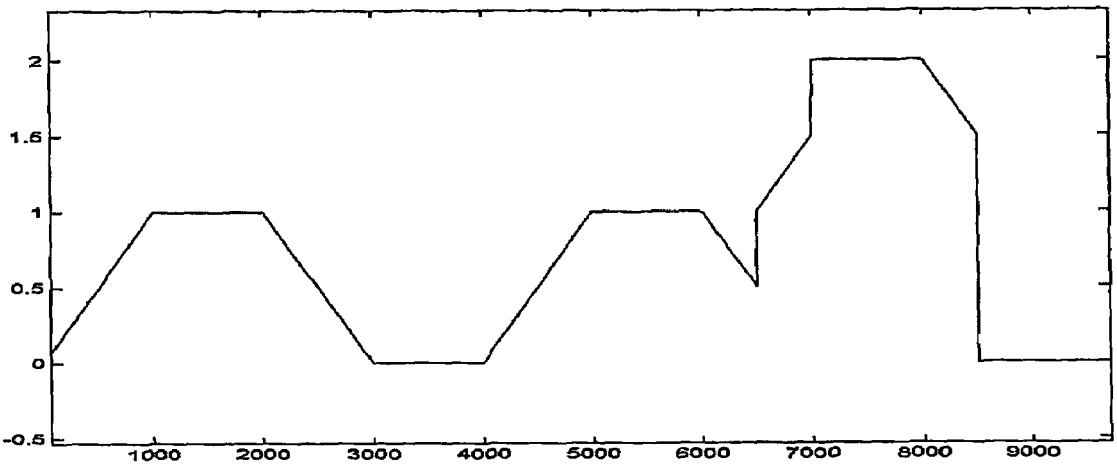
FIG. 5C is an illustration of the output of the envelope detector, with the waveform of FIG. 5B as the input.
Figure 5D:
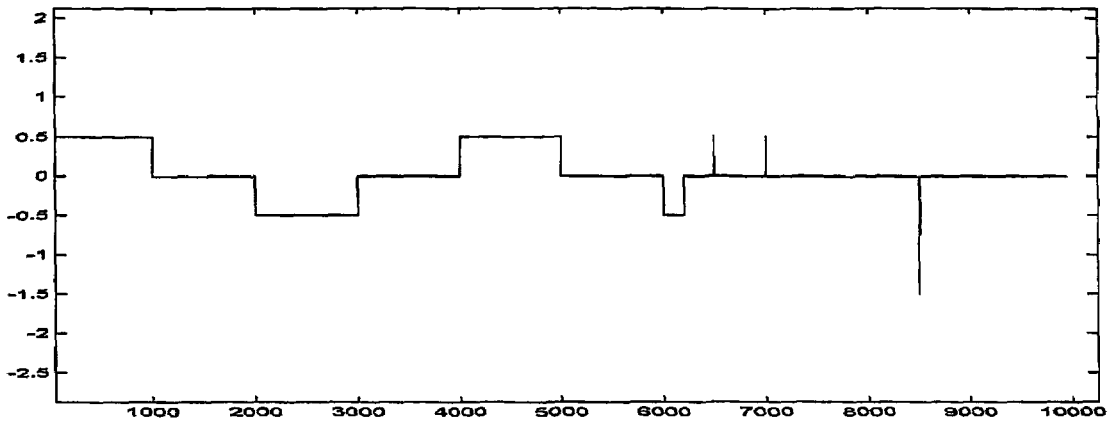
FIG. 5D is an illustration of the output of the differentiator, with the waveform of FIG. 5C as the input.
Figure 5E:
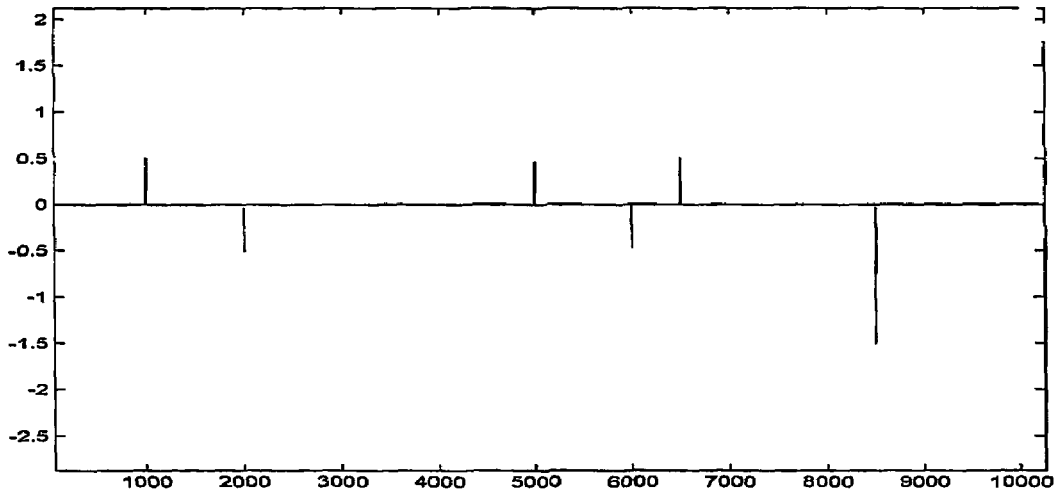
FIG. 5E is an illustration of the note markers produced by the note markers extractor, with the waveform of FIG. 5D as the input.

The flowchart of exemplary gradient-based segmentation in this invention is shown in FIG. 5A. The humming signal is similar to an amplitude modulated (AM) signal where the volume is modulated by the pitch frequency. The pitch signal is not useful for the segmentation algorithm. Thus, the pitch frequency is removed to simplify matters. The envelope detector step 501 removes the pitch frequency. In this way, only information pertaining to the variation of volume is left. The differentiator step 502 processes this variation to produce a gradient function and removes small gradient values in the gradient function. Finally, the note marker extractor step 503 extracts note markers from the threshold gradient function. A typical humming signal with three notes hummed is illustrated in FIG. 5B. The outputs of envelope detector, differentiator and note markers extractor are illustrated in FIGS. 5C, 5D and 5E respectively.

Envelope Detector

Figure 6:
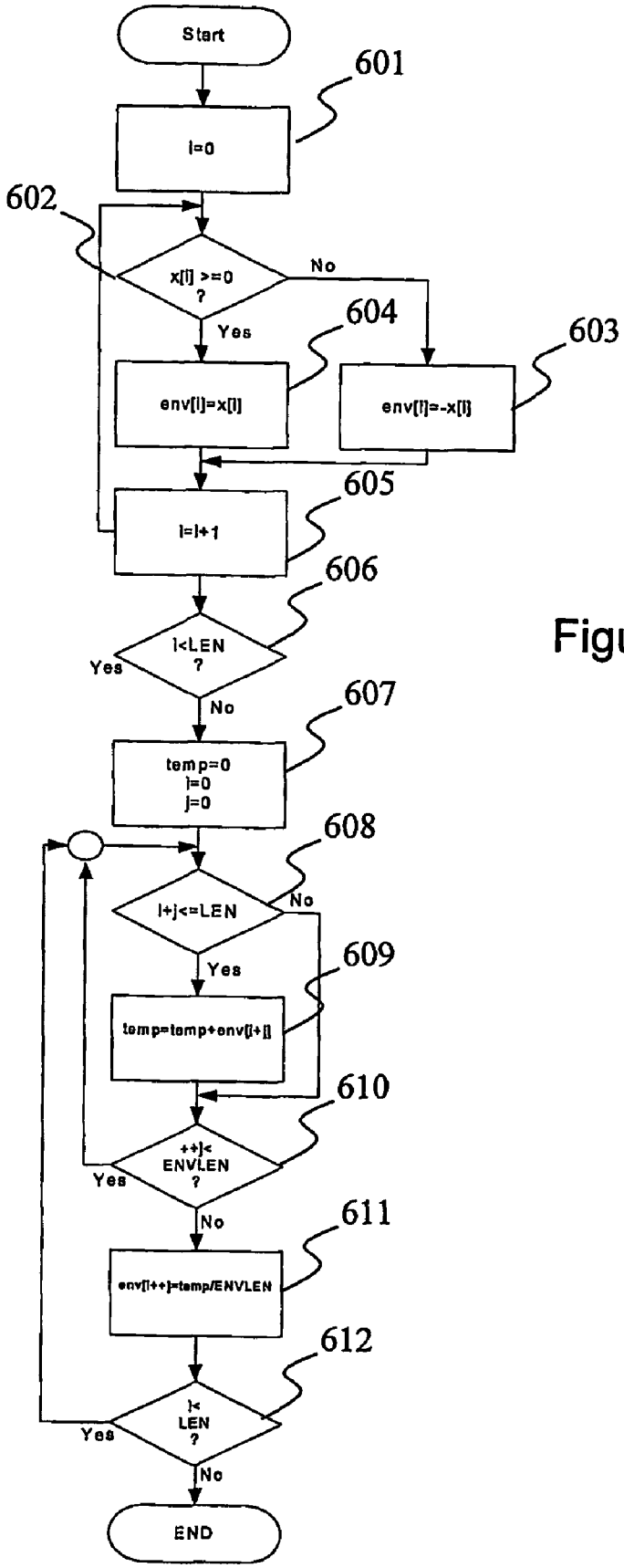
FIG. 6 is a flowchart of operation of an envelope detector used in the embodiment of FIG. 2.

FIG. 6 shows a flowchart for an exemplary envelope detector that is utilised in the gradient-based segmentation as shown in 501. The envelope detector consists of two steps: full wave rectification (processes 601 through 605) and a moving average low-pass filter.

The rectifier is simple. In step 601 a count of points in the signal, i, is set to "i=0". Following step 602 determines if the signal level at the current signal point is greater than or equal to zero. If it is not, then, in step 603, the envelope level for that point is set to the negative of the current signal level and i is incremented by 1 in step 605. If the current signal point is greater than or equal to zero, then, in step 604, the envelope level for that point is set to the actual signal level and i is incremented by 1 again in step 605. Step 605 is followed by step 606, which determines if "i<LEN", where LEN is a sample number, chosen here to be 200. If it is, then the process reverts to step 602. If it is not, then the process goes on to the filter.

The low pass filter is implemented by a simple moving average filter to obtain a smooth envelope of the discrete time audio signal. In spite of its simplicity, the moving average filter is optimal for common tasks such as reducing random noise while retaining a sharp step response. This property is ideal for this invention, as it is desirable to reduce the random-noise-like roughness while retaining the gradient. As the name implies, the moving average filter operates by averaging a number of points from the discrete signal to produce each point in the optimal signal. Thus it can be written as:

$$y(t) = \frac{1}{ENVLEN} \sum_{j=0}^{ENVLEN-1} x(t+j)$$

where x(t) is the discrete time audio signal with LEN samples, y(t) is the envelope signal of x(t) and ENVLEN is the number of points in the average. The ENVLEN is chosen to be 200 in this exemplary embodiment.

The process 607 initialises the necessary parameters "temp", "i" and "j" to zero to start the filtering proper. Before proceeding to filtering, the process 608 makes sure that the filter operates within the confine of the discrete time audio signal, by checking that the sum "i+j<LEN". The processes 609 and 610 compute the summation of all data after the current value. In particular, step 609 provides an updated temporary summation, with "temp=temp+[i+j]". The average value of the envelope for all "i" within the sample is computed as shown in 611, "env[i]=temp/ENVLEN". Step 612 tests whether the process of steps 608 to 611 has been repeated for all data in the input buffer and only when it has does the envelope process end. The "i" and "j" are incremented as show in 609 and 610 respectively. The "++j" is a pre-increment which means j is incremented between testing the condition. "i++" is a post-increment, which means "i" is incremented after execution of the equation shown in steps 610.

Differentiator

Figure 7:
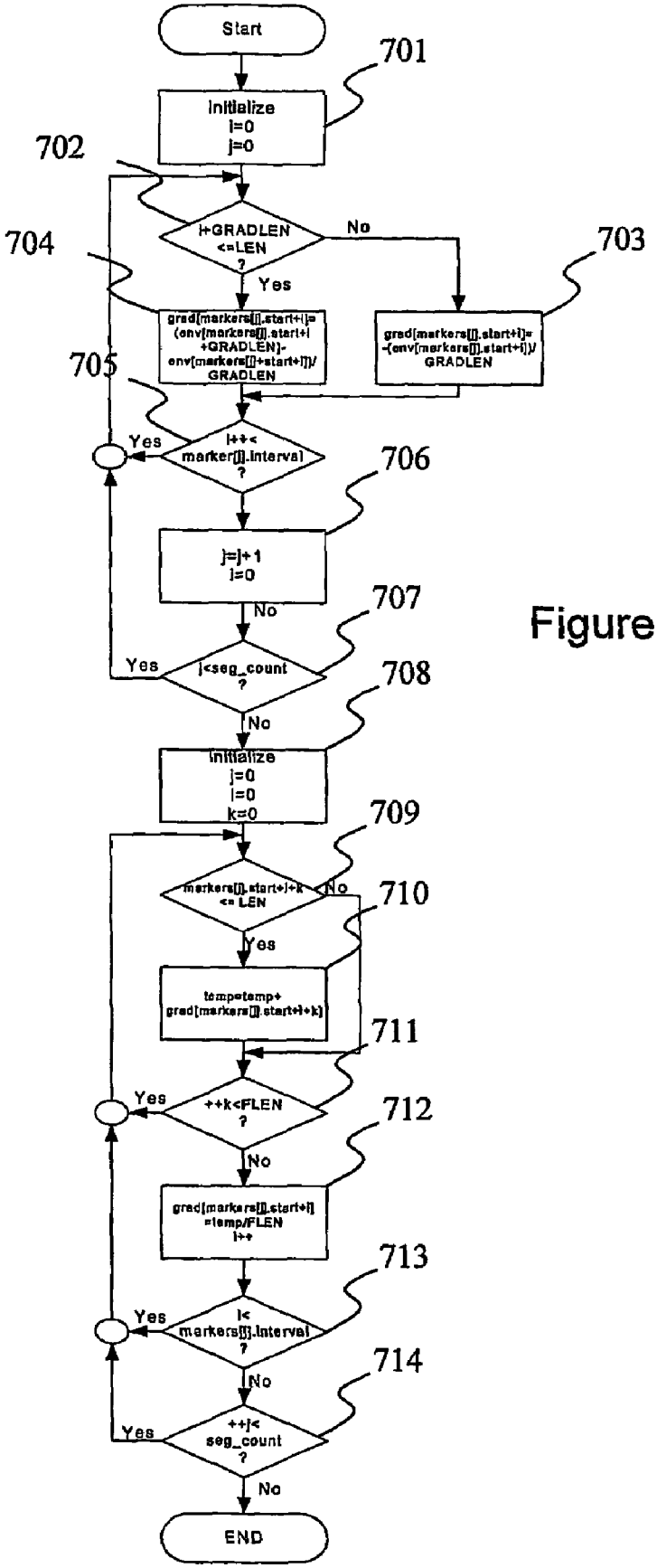
FIG. 7 is a flowchart of operation of a differentiator used in the embodiment of FIG. 2.

The flowchart of an exemplary differentiator is shown in FIG. 7. The differentiator consists of two steps: gradient computation and moving average low-pass filter. The differentiator processes the envelope produced by the envelope detector to generate a gradient function. The algorithm only computes the gradient values within the voiced portions marked by the markers produced by the silence discriminator. The gradient function essentially describes the changes of the input signal. This can be computed by:

$$\frac{\partial y(t)}{\partial t} \approx \frac{y(t+GRADLEN) - y(t)}{GRADLEN}$$

where y(t) is the envelope signal and GRADLEN is the deviation of t to the next point. The GRADLEN is chosen to be 20 in this exemplary embodiment.

The process is initialised in step 701. The index "j" keeps track of the segment that is being processed. The index "i" keeps track of the number of points within one segment is processed. A decision 702 prevents the overflow of the buffer that contains the envelope. "I+Gradlen" is tested against "LEN" to prevent overflow of the buffer as shown in 702. The gradient is computed by:

$$\text{Gradient} = \frac{[x(i+L) - x(i)]}{L}$$

where "L" is the step length, for instance 100. Therefore when there is an overflow, in step 703 the x(I+L) is set to zero. When there is no buffer overflow, the gradient is computed according to this above equation in step 704. The computation in process 703 caters to the case when the gradient to be computed is near the end of the buffer. The step 705 checks whether all the gradients within the "j" voice segment are computed. If it is true, it will proceed to step 706, else to decision 702. The step 706 increments the "j" to process the next voiced segment. The "i" is initialised to zero to start from the beginning of the segment. The decision 707 will check whether all voiced segments have been processed. It will proceed to decision 702 if not all voiced segments are processed.

The process 708 initialises the necessary parameters for the filtering operation. The filter smoothens the gradient to reduce roughness. The index of the buffer is tested as shown in 709 to prevent buffer overflow. The moving average filter is chosen to smoothen the gradient function. The filter is only applied to the voiced portions to reduce computation. The filter length is defined as FLEN and all data after the current value are summed as shown in 710. The index k is tested if it is greater than FLEN as shown in 711. The FLEN is chosen to be 200 in this invention. When the FLEN is reached, the gradient, grad, is updated as shown in 712. The process is repeated for all points inside the voiced portions, as shown in 713. The processes 709 through 714 are repeated until all voiced portions are processed.

Note Makers Extractor

Figure 8:
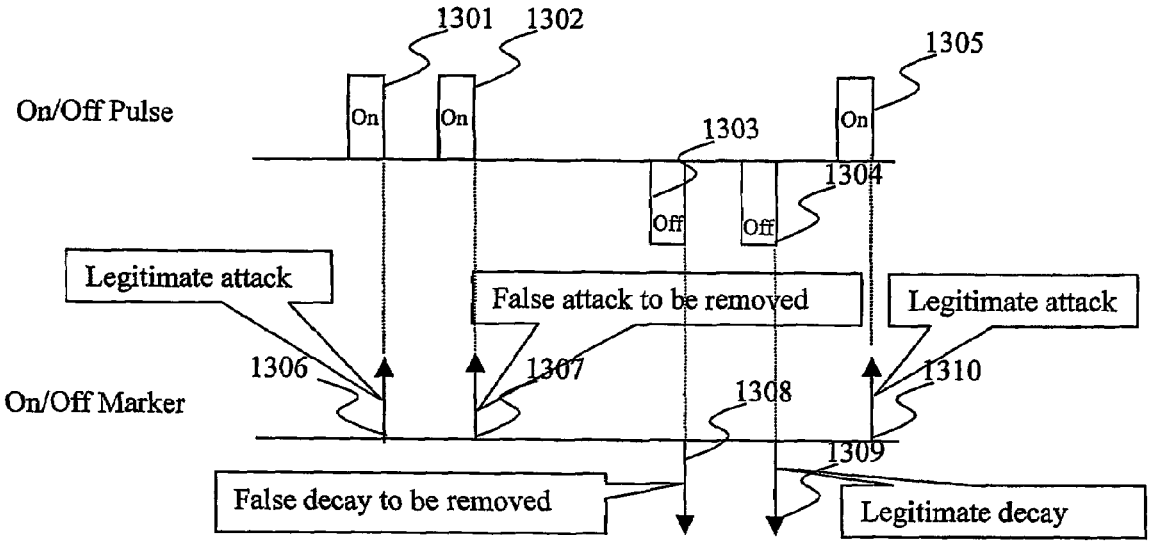
FIG. 8 is a schematic illustration of the criteria for selection of legitimate attack and decay.

Ideally, there is only a pair of positive and negative gradient peaks to mark the start and end of a note. However, human humming is not ideal and the problem is further complicated by the presence of expression that causes the amplitude in a particular note to change. Thus the note markers extractor has to remove invalid gradient peaks based on predefined criteria. These criteria are derived from the assumption that each note must be marked by an attack and followed immediately by a decay. Anything in between is considered a false alarm and has to be removed. FIG. 8 shows an example that illustrates the idea. FIG. 8 illustrates exemplary criteria for selection of legitimate attack and decay. The criteria of selection of the legitimate attack and decay are based on the idea that there is only one attack and decay for each note. The 1306 marker is the legitimate attack as it is the first marker detected. Since decay marker is expected, the 1307 marker is a false attack. Further down, the 1308 marker is temporary considered a decay marker. It will be a legitimate decay marker if an attack marker follows it. However, a decay marker 1309 follows it. Thus, marker 1308 is discarded and the marker 1309 is temporarily considered a decay marker. The detection of the attack marker 1310 means that marker 1309 can be formally registered as a legitimate decay marker.

Figure 9:
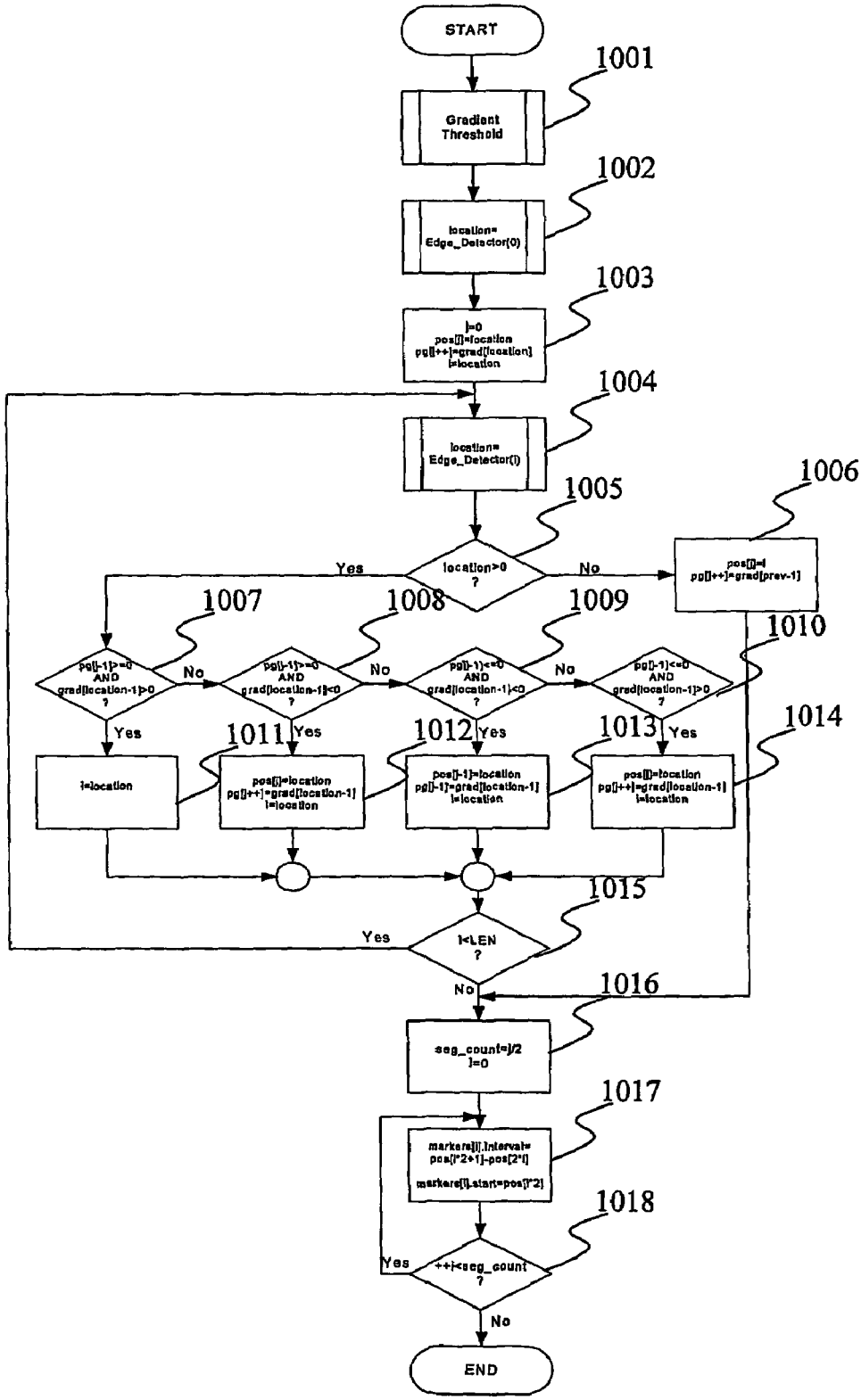
FIG. 9 is a flowchart of operation of a note marker extractor used in the embodiment of FIG. 2.

The flowchart in FIG. 9 shows an exemplary implementation of the abovementioned technique to remove redundant markers. The note markers extractor removes redundant ON/OFF markers and registers a set of legitimate note markers. A gradient thrashold module 1001 is first called to remove small gradient values generated by the differentiator 212. It produces a train of ON/OFF pulses. An edge detector function is called to search for edges from the ON/OFF pulse starting from location 0 as shown in 1002. With the location of the nearest marker, the necessary parameters are initialised as shown in 1003. In the process 1003, pos and pg are:

| Parameter | Definition |
|---|---|
| pos | Location of the legitimate attack and decay in the gradient array. |
| pg | The gradient value of the legitimate attack and decay. |

The algorithm enters a loop to search and remove all redundant markers as shown in 1004 through 1015. The next edge is detected using the edge detector starting from the location of the edge found in the last search as shown in 1004. The test 1005 ensures that the edge detector has found an edge. The 1007 tests for the case when an attack marker is detected while an attack marker is registered in the previous iteration. In this case, the attack marker detected is discarded and the index is incremented to the location of the attack marker as shown in 1011. The 1008 tests for the case when a decay marker is detected and an attack marker is detected in the previous iteration. Thus, the decay marker detected is registered as a legitimate decay marker as shown in 1012. The 1009 tests for the case when a decay marker is detected but a decay marker is registered at the previous iteration. Thus, the current detected marker replaces the previous one as shown in 1013. Finally, the 1010 tests for the case when an attack marker is detected and a decay marker is detected in the previous iteration. Therefore, the attack marker is registered as shown in 1014. At a time when the edge detector is unable to find any edge, there is a final registration of markers for those still pending, as shown in 1006. Since there are no more edges, the process 1006 breaks out of the loop and continues to the process 1016. The seg_count is calculated as the half of the total number of markers registered, as shown in 1016. The processes 1017 and 1018 update the markers struct with data from pos.

Gradient Threshold

FIG. 10 shows a flowchart of a simple method to remove the unwanted small gradient values. The gradient values are tested as shown in 901. If the absolute value is less than GRADTHRES, it is set to zero as shown in 904. If the value is greater than GRADTHRES and positive, it will be set to a positive number. If the value is greater than GRADTHRES and negative, it will be set to a negative number. Here, +10 and −10 are used, respectively, as an example. This process is shown in 902 through 906. In the end, the gradient threshold function will produce positive and negative pulses such as those shown in 1301 through 1305.

Edge Detector

The On/OFF pulses as shown in FIG. 8 symbolise the location of high gradients. The positive going edges of the pulses as shown by 1301 and 1302 are the location where gradient values transit from low to high. On the other hand, the negative going edges of the pulse as shown by 1301 and 1302 are the locations where the gradient transit from high to low. Thus the negative going edge of the ON pulse is the turning point of the increasing envelope to a level value. The negative going edge of the ON pulse is detected using the edge detector to obtain the ON markers such as those shown in 1306 and 1307. Similarly, the positive going edge of the OFF pulse is detected using the edge detector to obtain the OFF markers such as those shown in 1308 and 1309.

FIG. 11 is a flowchart of an exemplary pulse edge detector. The pulse edge detector detects the next positive or negative edge starting from the location specified by start. The process 801 initialises the search index, i, to the desired start location. The ps is set to −1 to signal that no previous transition is detected. A non-zero gradient and ps=−1 means that this is the first time an edge is found as tested in 802. Therefore, ps is set to 1 to signal that the first edge is detected as shown in 804. When the gradient value is zero and ps=1, the second edge is detected as tested in 803. This is a negative going edge for ON pulses and positive edge for OFF pulses. Having detected this edge, the current search index will be return as the edge detected as shown in 808. The processes from 802 through 805 will repeat until all data are exhausted. If the all data are exhausted as tested in 806 and no edge is detected, a −1 will be returned as in 807.

Pitch Detector

The pitch detector 202 detects the pitch of all note registered in the markers data structure. Every note interval is divided into blocks that consist of PLEN samples. The PLEN is chosen to be 100 in this invention. Thus the pitch detection range for an 8 KHz sampled audio signal is between 80 to 8 KHz. The signal in each block is assumed to be stationary and the pitch (frequency) is detected by autocorrelation as shown below:

$$r_{xx}(n) = \frac{1}{PLEN} \sum_{k=0}^{PLEN-n-1} x(k)x(k+n)$$

where x(k) is the discrete time audio signal.

With this equation, a collection of pitch values that belong to the same note might be found. In an ideal case, these values are identical. However, the autocorrelation pitch detector is sensitive to harmonics that cause errors. Furthermore, the hummer might fail to maintain the pitch within the duration of a particular note.

Figure 12:
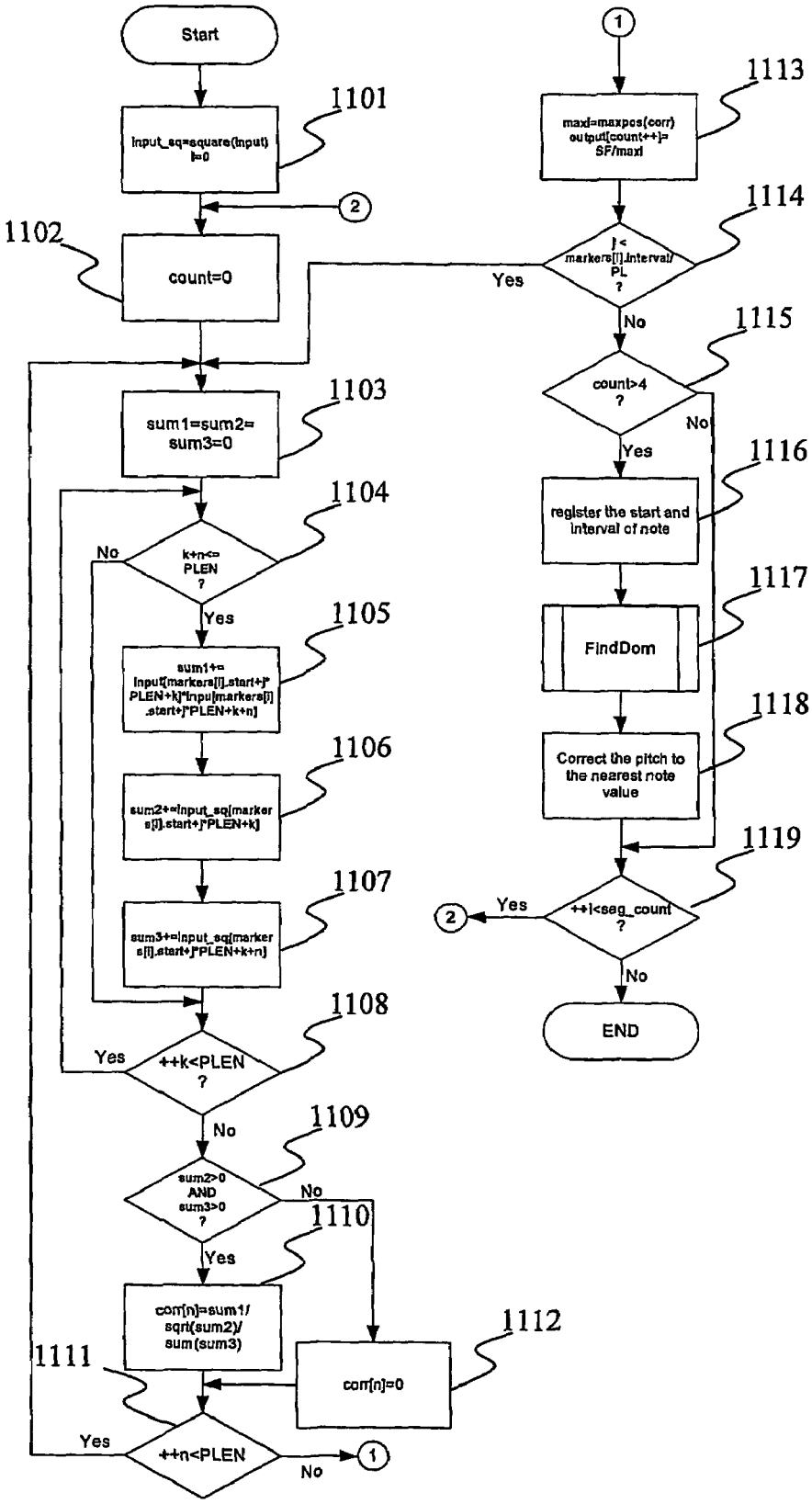
FIG. 12 is a flowchart of operation of a pitch detector used in the embodiment of FIG. 2.

FIG. 12 shows the flowchart of an exemplary pitch detector. The process 1101 computes the square of the input data. The pitch detector is an autocorrelation-based pitch detected with some modification. The processes 1102 through 1114 compute the normalised autocorrelation function and find the pitch values of each block in a note.

A data structure is set up as described below using the syntax of the C programming language.

```
struct hum_des{
        int pitch;
        int start;
        int interval;
        };
```

where markers is the struct that marks the start and the interval of the voiced portion. Thus there is an array of these markers with note_count members. The position and interval of a note are registered as:

hum_des[j].start=marker[j].start hum_des[j].inteval=marker[j].interval where j is the index and 0≦j<total number of markers.

The pitch values detected may vary due to the failure of a user to maintain the pitch within a single note. Step 1115 checks whether the count (compare step 1102) is greater than 4. The FindDom function as shown in 1117 finds the dominant pitch value. In this invention, the detected pitch values are corrected to the nearest MIDI number in 1118. The MDI number is computed as:

$$\text{hum_des}[j].\text{pitch} = 49 + \frac{\text{floor}\left[12\log\left(\frac{\text{detected_pitch}}{440}\right)\right]}{\log 2}$$

The floor(x) function returns a floating-point value representing the largest integer that is less than or equal to x. The process is repeated until all notes in the input data have their pitch detected as shown in 1119.

Dominant Pitch Detector

The function of a dominant pitch detector is to collect statistics from the collection of pitch values to find the prominent pitch values. In this invention, the k-mean clustering method is selected to find the prominent pitch values. The k-mean clustering method does not require any prior knowledge or assumption about the data except for the number of clusters required. Determining the number of clustering is problematic in most applications. In the current invention, the clustering algorithm only needs to cluster the pitch values into two groups: the prominent cluster and the outlier cluster.

FIG. 13: is a flowchart of an exemplary dominant pitch detector (step 1117 of FIG. 12), which uses a k-mean clustering algorithm that classifies the pitches into these two groups. The k-mean clustering is an iterative algorithm for clustering data to reveal the underlying characteristic. The number of pitches is tested to check if it is greater than 3, as shown in decision 1202. The lower and upper 20% of the data are discarded to avoid portions of the note that are unstable as shown in 1204. All the pitches will be used for the computation if the number of pitches is less than 3. This is attained by setting "lower=0" and "upper" to the number of pitches as shown in 1203. The centres of the two clusters are initialised to the maximum and minimum values of the data set as show in 1201 through 1210. The index "j" is set to the lower, as shown in 1205. The process 1211 initialises the necessary parameters and saves the current centres for comparison at a later stage.

The pitch values of the note under test are contained in the array pitch. The process 1212 compares the absolute distance of the pitch value from the two centres. The pitch value is added to the accumulators called, temp1 or temp2 depending on the result of the comparison as shown in 1213 and 1214. This process repeats until all the pitch values in the note are tested as shown in 1215. When the test in 1215 yields a "No," it is tested at 1216 and 1217 whether count 1 and count 2 (compare step 1211) >0 respectively. The new centres are computed and the member counts are incremented as shown in 1218 and 1219. They are the average of the member pitch values. The processes 1220 and 1221 test if the two centres change. If the two centres do not change, the iteration stops immediately. If there are changes in any of the centres, the iteration of the processes from 1211 through 1221 repeat until the maximum number of loops (MAXLOOP) has been reached as tested in step 1222. The maximum number of loops is 10 in this exemplary embodiment.

If the numbers of members of the two centres is close, as tested in 1223, the average of the two centres is returned as the dominant pitch. If they are not close enough and count 1>count 2 as determined at step 1224, the centre with the larger number of members is returned as the dominant pitch as shown in 1225 through 1227. In this way, the cluster with the highest number of members is classified as the prominent cluster while the other cluster is classified as the outlier cluster. The pitch of the note is set to the centre of the prominent cluster.

It is in fact possible for the invention to work without the silence discriminator.

Note extraction is a simple module to gather information from note marker generator and pitch detector. It then filled a structure that describe the begin time, duration and the pitch value. Feature extraction converts the note descriptors to feature that are used by the search engine. The current feature is the melody contour that is specified in the MPEG-7 standard. The description generation is an optional module that converts the feature to a format for storage or transmission.

Effects of Invention

The invention achieves the conversion of human (or animal—e.g. dolphin et al) humming, singing, whistling or other musical noises to musical notes. The gradient-based segmentation goes beyond the traditional segmentation method that relies on silence. The modified autocorrelation-based pitch detector can tolerate a user's failure to maintain pitch within a single note. This means that the user can hum naturally without consciously trying to pause between notes, which may not be easy for some users with little musical background.

While exemplary means of achieving the particular component processes have been illustrated, other means achieving similar ends can readily be incorporated.

The invention claimed is:

1. A method for detecting the pitch values of notes in a musical sound signal, comprising the steps of:

identifying one or more voiced segments in the sound signal using an energy function of the sound signal;

applying a gradient-based processing to said voiced segments for dividing each voiced segment into one or more notes; and deriving pitch values of the respective notes in the sound signal.

2. A method according to claim 1, wherein the process of dividing the voiced segments into notes uses note markers to do so.

3. A method according to claim 2, wherein the process of deriving the pitch values of the respective notes comprises dividing portions of each voiced segment between the note markers into blocks.

4. A method according to claim 3, wherein each portion contains the same number of blocks.

5. A method according to claim 1, wherein the process of deriving the pitch values of the respective notes comprises applying k-mean clustering on pitch values derived for the blocks between the note markers.

6. A method according to claim 1, further comprising the step of rounding the derived pitch values of the respective notes to the nearest note values.

7. A method according to claim 1, wherein the identifying of the voiced segments is performed based on a determination of silences in the sound signal.

8. A method according to claim 1, further comprising the step of extracting notes from said pitch values to create note descriptors.

9. A method according to claim 1, wherein the sound signal is digitized.

10. A method according to claim 1, wherein the sound signal is an audio signal of a sound produced by a person.

11. A method according to claim 10, wherein the sound comprises one or more of the group of: humming, singing and whistling at least a portion of a piece of music.

12. Apparatus for use in use in detecting the pitch values of notes in a musical sound signal, operable according to the method of claim 1.

13. Apparatus for detecting the pitch values of notes in a musical sound signal, comprising:

means for identifying one or more voiced segments in the sound signal using an energy function of the sound signal;

means for applying a gradient-based processing to said voiced segments for dividing each voiced segment into one or more notes; and means for deriving pitch values of the respective notes in the sound signal.

14. Apparatus according to claim 13, wherein said means for applying a gradient-based processing uses note markers to isolate notes.

15. Apparatus according to claim 14, wherein the means for deriving the pitch values of the respective notes divides portions of each voiced segment between the note markers into blocks.

16. Apparatus according to claim 15, wherein each portion contains the same number of blocks.

17. Apparatus according to claim 13, wherein the means for deriving the pitch values of the respective notes is operable to apply k-mean clustering on block pitch values derived for the blocks between the note markers.

18. Apparatus according to claim 13, further comprising means for rounding the derived pitch values of the respective notes to the nearest note values.

19. Apparatus according to claim 13, wherein the means for identifying the voiced segments operates based on a determination of silences in the sound signal.

20. Apparatus according to claim 13, further comprising means for extracting notes from said pitch values to create note descriptors.

21. Apparatus according to claim 13, operable to process a digital musical sound signal.

22. Apparatus according to claim 13, operable to process a musical sound signal being an audio signal of a sound produced by a person.

23. Apparatus according to claim 22, wherein the sound comprises one or more of the group of: humming, singing and whistling at least a portion of a piece of music.

* * * * *